US006246305B1

(12) United States Patent
Youngner et al.

(10) Patent No.: US 6,246,305 B1
(45) **Date of Patent: *Jun. 12, 2001**

(54) APPARATUS AND METHOD FOR OPERATING A MICROMECHANICAL SWITCH

(75) Inventors: Daniel W. Youngner, Maple Grove; Jeffrey A. Ridley, Burnsville, both of MN (US)

(73) Assignee: Honeywell International INC, Morristown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/456,107

(22) Filed: Dec. 7, 1999

Related U.S. Application Data

(63) Continuation-in-part of application No. 09/223,559, filed on Dec. 30, 1998, now Pat. No. 6,040,749.

(51) Int. Cl.[7] ..... H01F 51/22
(52) U.S. Cl. ..... 335/78; 335/124
(58) Field of Search ..... 335/78–86, 124, 335/128; 257/414, 415, 421; 200/181

(56) References Cited

U.S. PATENT DOCUMENTS 5,872,496 * 2/1999 Asada et al. ..... 335/78
6,040,749 * 2/1999 Youngner et al. ..... 335/78

OTHER PUBLICATIONS

Micromachined Magnetostatic Switches, NASA Tech Briefs, Oct., 1998, p. 58.

Technical Support Package to Micromachined Magnetostatic Switches, Oct., 1998, NASA Tech Brief, vol. 22, No. 10.

"Electrostatically Actuated Micromechanical Switches Using Surface Micromachining", Northeastern University web site: www.ece.neu.edu/edsnu/zavrocky/mf1/programs/relay.html. 8 pp., circa: Jan. 13, 1998.

* cited by examiner

*Primary Examiner*—Lincoln Donovan
*Assistant Examiner*—Tuyen Nguyen
(74) *Attorney, Agent, or Firm*—Roland W. Norris; Andrew A. Abeyta

(57) ABSTRACT

A micromechanical switch and a method for operating the micromechanical switch between an open position and a closed position by moving a magnet between two positions. The magnet produces a magnetic flux that travels through a magnetically conductive layer. The magnetic flux within the magnetically conductive layer forcibly draws a contact element into contact with an electrically conductive layer and electrically shorts the open electrical contacts.

18 Claims, 6 Drawing Sheets

APPARATUS AND METHOD FOR OPERATING A MICROMECHANICAL SWITCH

RELATED APPLICATIONS

This is a continuation in part of Ser. No. 09/223,559, filed Dec. 30, 1998 now U.S. Pat. No. 6,040,749.

BACKGROUND OF THE INVENTION

1. Field of the Invention

This invention relates to a micromechanical switch and a method for operating the micromechanical switch wherein a permanent magnet is moved between two positions, one position where the micromechanical switch is normally open and another position where the micromechanical switch is normally closed.

2. Discussion of Related Art

Conventional micro switches that operate between an open position and a closed position use electrostatic forces, elastic forces or thermally-induced forces to operate the micro switch. Conventional electrostatically actuated switches and relays experience excessive charge build-up which causes a magnitude of a closing force, which is necessary to operate the micro switch, to change over time.

SUMMARY OF THE INVENTION

It is one object of this invention to provide a micromechanical switch that is operated between a normally closed position and a normally open position by moving a permanent magnet between two positions.

It is another object of this invention to provide a micromechanical switch that electromagnetically draws a free end of a cantilever arm toward a first conductive layer or a second conductive layer to form a normally closed conductive path or a normally open conductive path.

It is another object of this invention to provide a micromechanical switch which uses magnetic forces to transmit externally acting forces necessary to open and close the micromechanical switch.

It is yet another object of this invention to provide a micromechanical switch that can be manufactured using conventional integrated circuit processing techniques.

It is still another object of this invention to provide a micromechanical switch wherein contacting surfaces that complete a conductive path are hermetically sealed and isolated from an external environment in which the switch body resides.

The above and other objects of this invention are accomplished with a micromechanical switch that has a magnet which is moved between two positions to set the micromechanical switch in a normally closed position or a normally open position. In one preferred embodiment of this invention, the magnet moves within a slot at least partially formed by primary openings in a first conductive layer and in a second conductive layer. However, it is apparent that several other various magnet configurations, path configurations and/or mechanical elements can be used to move the magnet between the two positions.

An actuator is used to selectively move the magnet between the two positions. The actuator may be a pushbutton switch or any other suitable mechanical switch used to move the magnet between two positions. The actuator can be automatically or manually operated.

A contact element is moveably mounted between two different positions, one position within one secondary opening of the first conductive layer and another position within another secondary opening within the second conductive layer. In one preferred embodiment of this invention, when the magnet is in the first position, the contact element is positioned within or bridges the secondary opening of the first conductive layer, and when the magnet is in the second position, the contact element is positioned within or bridges the secondary opening of the second conductive layer.

The contact element can be mounted to or integral with a free end of a cantilever arm. The cantilever arm preferably has a fixed end secured to the same substrate on which the first conductive layer and/ or the second conductive layer is supported. It is apparent that suitable mechanical arrangements can be used to allow the contact element to move between the secondary openings of the first conductive layer and of the second conductive layer.

The magnetic forces used to open and close the micromechanical switch of this invention can be of several orders of magnitude stronger than other conventional electrostatic forces, elastic forces or gravitational forces necessary to operate other conventional micromechanical switches. There is an apparent need to provide a micromechanical switch that uses a moveable magnet to operate the micromechanical switch between a normally open position and a normally closed position. One preferred embodiment of this invention is particularly suited for satisfying such need, by using a contact element of a free end of a cantilever arm to move toward either the first conductive layer or the second conductive layer upon electromagnetic demand from electromagnetic forces acting through the first conductive layer or the second conductive layer.

BRIEF DESCRIPTION OF THE DRAWINGS

The objects of this invention and features of a micromechanical switch according to this invention, as discussed throughout this specification, can be better understood when taken in view of the drawings, wherein.

DETAILED DESCRIPTION OF PREFERRED EMBODIMENTS

Figure 1:
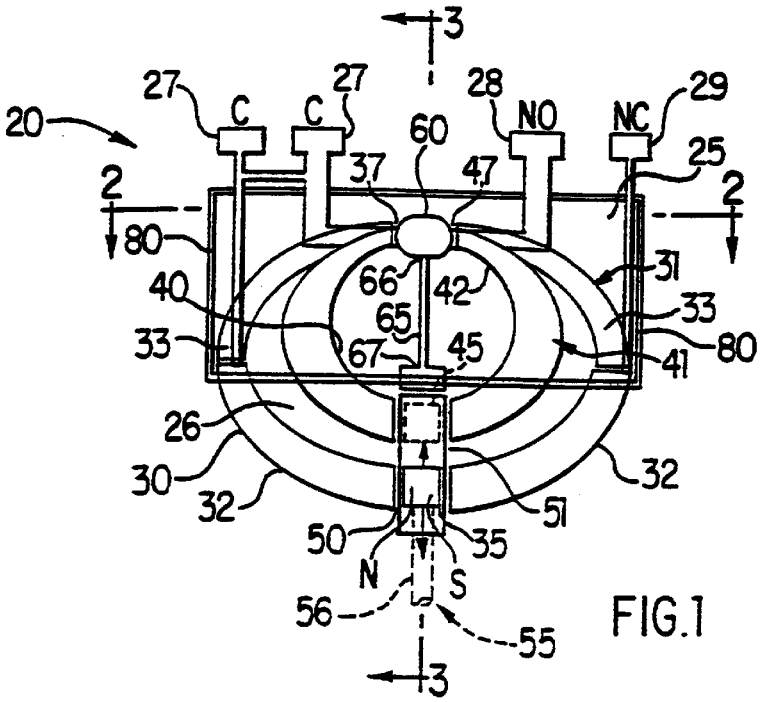
FIG. 1 is a schematic top view of a layout for a first conductive layer, a second conductive layer, a magnet, a common contact, a normally open contact, and a normally closed contact, for a micromechanical switch according to one preferred embodiment of this invention.
Figure 2:
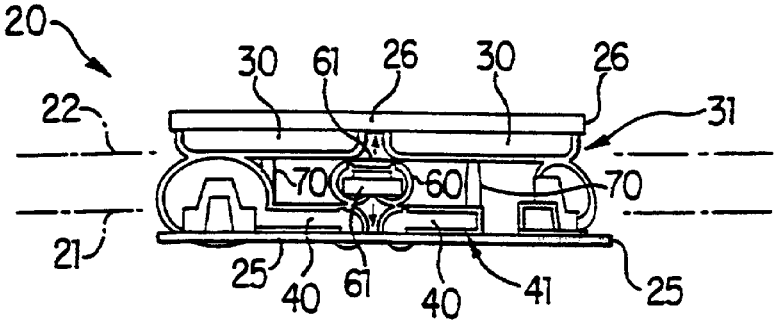
FIG. 2 is a schematic sectional view taken along line 2—2, as show in FIG. 1.
Figure 3:
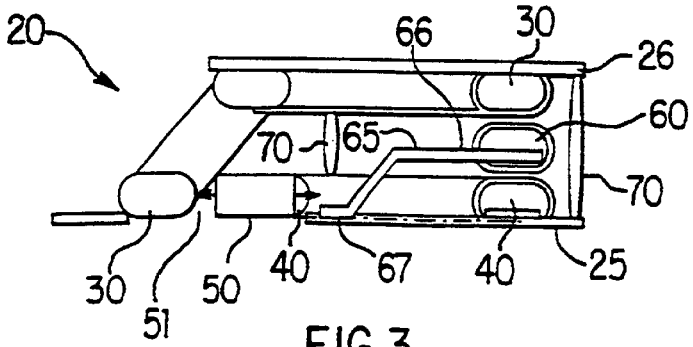
FIG. 3 is a schematic sectional view taken along line 3—3, as shown in FIG. 1.

As schematically shown in FIGS. 1–3, in one preferred embodiment of this invention, micromechanical switch 20 comprises conductive layer 30 and conductive layer 40 which are preferably conductively isolated from each other. As explained in further detail below, magnet 50 is moved between a magnet first position and a magnet second position to operate micromechanical switch 20 between a normally closed position and a normally opened position.

Figure 5:
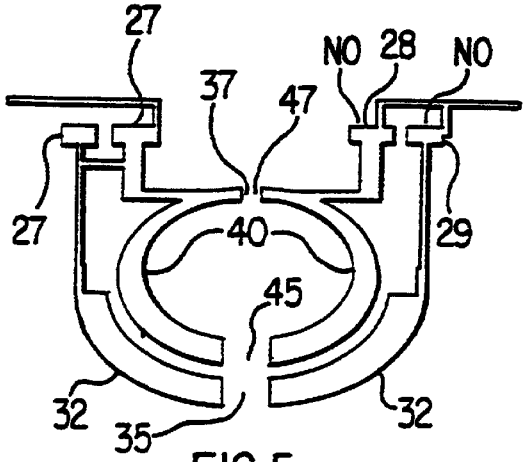
FIGS. 5, 8 and 11 are schematic top views of a micromechanical switch according to one preferred embodiment of this invention, showing different development stages as the integrated circuit is manufactured.

Conductive layer 30 forms closure path 31 which has primary opening 35 and secondary opening 37, as shown in FIGS. 1 and 5. Conductive layer 40 forms closure path 41 and has primary opening 45 and secondary opening 47, as shown in FIGS. 1 and 5. In one preferred embodiment of this invention, primary opening 35 and primary opening 45 form at least a portion of slot 51. Magnet 50 is moveably mounted with respect to conductive layer 30 and conductive layer 40. Although magnet 50 may be moveably mounted within slot 51, such as shown in FIG. 1, it is apparent that any other suitable shape of primary opening 35 and/or primary opening 45 can be used to form a path over which magnet 50 moves between the magnet first position and the magnet second position. Although FIG. 1 shows slot 51 as a linear path over which magnet 50 moves, it is apparent that any other suitably shaped path can be used to move magnet 50 between the first position and the second position of magnet 50. It is also apparent that the shape of magnet 50, primary opening 35 and/or primary opening 45 can be varied to accommodate each different layout and design of conductive layer 30 and/or conductive layer 40.

Actuator 55 is preferably used to selectively move magnet 50 between the magnet first position and the magnet second position. In one preferred embodiment according to this invention, actuator 55 comprises pushrod 56, as schematically shown by the dashed lines in FIG. 1. Pushrod 56 can comprise any suitable mechanical structure used to move magnet 50 with respect to conductive layer 30 and/or conductive layer 40.

In another preferred embodiment according to this invention, actuator 55 may comprise any suitable mechanical device connected to magnet 50. It is also apparent that magnet 50 can be moved using an independent electrical, electromechanical or electromagnetic device.

As shown in FIGS. 1–3, contact element 60 is moveably mounted with respect to conductive layer 30 and/or conductive layer 40. Contact element 60 moves between an element first position and an element second position. In one preferred embodiment of this invention, when in the element first position contact element 60 electrically shorts conductive layer 30 across secondary opening 35, and when in the element second position contact element 60 electrically shorts conductive layer 40 across secondary opening 47. The arrows in FIG. 2 indicate a direction in which contact element 60 moves, according to one preferred embodiment of this invention.

As shown in FIG. 2, when moved upward contact element 60 contacts or bridges conductive layer 30 across secondary opening 37. Also as shown in FIG. 2, when moved downward contact element 60 contacts or bridges conductive layer 40 across secondary opening 47. It is apparent that other suitable shapes of conductive layer 30, conductive layer 40, secondary opening 37, secondary opening 47 and/or contact element 60 can be used to achieve the same result of bridging and thus electrically shorting conductive layer 30 across secondary opening 37 or bridging and thus electrically shorting conductive layer 40 across secondary opening 47, for the purpose of closing closure path 31 or closing closure path 41.

As shown between FIGS. 1, 2 and 5, in one preferred embodiment of this invention, at least primary portion 32 of conductive layer 30 is positioned within plane 21. FIG. 1 shows secondary portion 33 of conductive layer 30. In the embodiment shown in FIGS. 1–3 and 5, a plating-up process can be used to form conductive material that causes an electrical short between primary portion 32 and secondary portion 33 of conductive layer 30. As shown in FIG. 2, secondary portion 33 is positioned within plane 22 which is spaced at a distance from plane 21. Although other suitable shapes and arrangements can be used to form conductive layer 30 and/or conductive layer 40, the embodiment shown in FIGS. 1–3, or any other suitable structurally equivalent layout and design, as long as contact element 60 is able to move between the element first position and the element second position.

As shown in FIGS. 1–3, primary portion 32 of conductive layer 30 forms primary opening 35 and secondary portion 33 of conductive layer 30 forms secondary opening 37. Also as shown in FIGS. 1–3, slot 51 is rectangularly shaped so that primary opening 35 and primary opening 45 align with each other.

In the embodiment shown in FIGS. 1–3, with contact element 60 in the element first position, contact element 60 is positioned at least partially within plane 21, and in the element second position, contact element 60 is positioned at least partially within plane 22. As used in this specification and the claims, contact element 60 being positioned at least partially within plane 21 or plane 22 means that in the element first position contact element 60 contacts or bridges and thus electrically shorts conductive layer 30 across secondary opening 37 and simultaneously contact element 60 does not contact or bridge and thus does not electrically short conductive layer 40. Likewise, the language means that contact element 60 when in the second position contacts or bridges and thus electrically shorts conductive layer 40 across secondary opening 47 but does not contact or bridge and thus does not electrically short conductive layer 30.

In one preferred embodiment according to this invention, contact element 60 comprises head 61 positioned at free end 66 of cantilever arm 65. Fixed end 67 of cantilever arm 65, which is opposite free end 66, is preferably secured with respect to conductive layer 30 and/or conductive layer 40, such as directly on substrate 25. Head 61 can have any suitable shape that forms sufficient contact with conductive layer 30 across secondary opening 37 or with conductive layer 40 across secondary opening 47. Cantilever arm 65 allows head 61 of contact element 60 to move in a vertical direction, as shown by the arrows in FIG. 2, between the element first position and the element second position.

With magnet 50 in the magnet first position, a magnetic circuit is formed as magnetic flux from magnet 50 travels through conductive layer 30, from primary portion 32 to secondary portion 33, and then creates an electromagnetic force across secondary opening 33 that draws contact element 60 toward conductive layer 30, such as in an upward direction as shown in FIG. 2. When contact element 60 contacts conductive layer 30, an electrical short is formed across secondary opening 37. With magnet 50 in the magnet second position, a magnetic circuit is formed as magnetic flux from magnet 50 travels through conductive layer 40 and creates an electromagnetic force that draws contact element 60 toward conductive layer 40, such as in a downward direction as shown in FIG. 2. When contact element 60 contacts conductive layer 40, conductive layer 40 is electrically shorted across secondary opening 47.

When magnet 50 is in the magnet first position and contact element 60 closes closure path 31, conductive layer 30 forms electrical communication between common contact 27 and normally closed contact 29. With magnet 50 in the magnet second position and contact element 60 closing closure path 41, conductive layer 40 forms electrical communication between common contact 27 and normally open contact 28. Thus, by moving magnet 50 between the magnet first position and the magnet second position and thereby correspondingly moving contact element 60, micromechanical switch 20 can be operated in either the normally open position or the normally closed position. Magnetic forces of magnet 50 can be several orders of magnitude stronger than conventional micromechanical switches using electrostatic forces, elastic forces or gravitational forces to operate the micromechanical switch. By positioning secondary portion 33 of the conductive layer 30 within plane 22, which is at a distance from conductive layer 40 within plane 21, cantilever arm 65 can be used to assure strong bi-directional opening and closing forces, thereby rendering micromechanical switch 20 of this invention particularly suitable for double-throw switches.

With the cantilever design of cantilever arm 65, thermal expansion along a length of cantilever arm 65 more suitably accommodates an in-rush of electrical current each time micromechanical switch 20 is closed, particularly if head 61 of contact element 60 bounces against conductive layer 30 or against conductive layer 40. As shown in FIGS. 1–3, head 61 of contact element 60 can be rounded to reduce a contact area and thereby reduce sticking and/or electrostatic pulling forces.

Micromechanical switch 20 of this invention can be fabricated using conventional integrated circuit processing techniques know to those skilled in the art of silicon chip design. FIGS. 4–11 show different steps used to manufacture micromechanical switch 20 of this invention.

Figure 4:
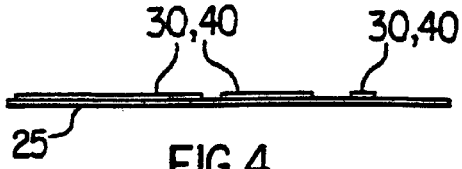
FIGS. 4, 6, 7, 9 and 10 are schematic sectional views

As shown in FIG. 4, conductive layers 30 and 40 are mounted, supported or formed on substrate 25. Substrate 25 may comprise any suitable conventional silicon wafer material. Conductive layer 30 and/or conductive layer 40 may comprise a layer of gold (Au) sandwiched between two layers of titanium (Ti). FIG. 5 shows a schematic top view of the layout of primary portion 32 of conductive layer 30, conductive layer 40, common contact 27, normally open contact 28 and normally closed contact 29.

Figure 6:
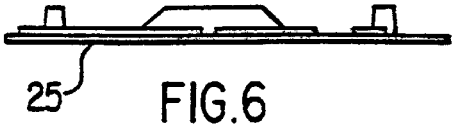

FIG. 6 shows a sectional side view where a layer of a polyimide is deposited, cut and etched, preferably slope etched.

Figure 7:
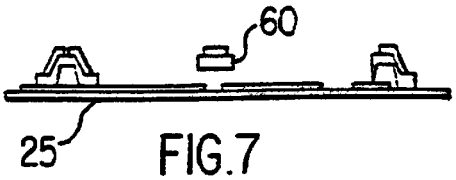
Figure 8:
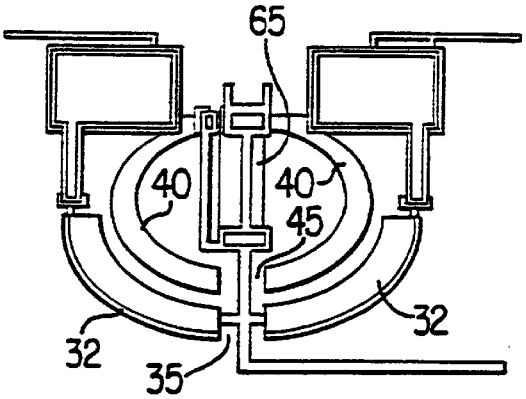

FIG. 7 shows a schematic diagram of the structure of FIG. 2 which is further deposited, cut and etched to form cantilever arm 65 and contact element 60, and then is further etched to remove the polyimide and portions of the Ti and the Au. FIG. 8 shows a schematic top view of the structure as shown in FIG. 7. The structure is then electroplated, such as with NiFe and then rhodium (Rh).

Figure 9:
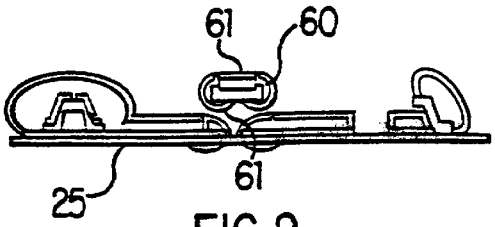

As shown in FIG. 9, the structure is then photocut, and plating bars and metal on cantilever arm 65 are wet etched, so that cantilever arm 65 is partially free. $SiO_2$ is cut and etched to free a tip portion of cantilever arm 65. At this stage the first wafer structure which comprises substrate 25 is complete.

Figure 10:
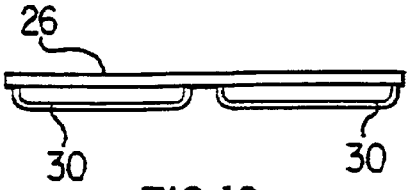
Figure 11:
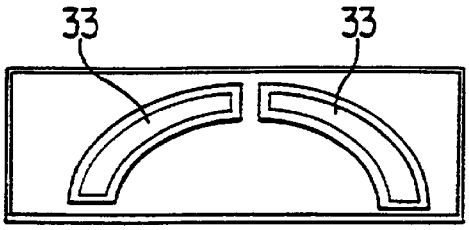

A top cap structure is then manufactured, such as shown in FIG. 10, where Ti and Au are blanket deposited as a plating base on substrate 26, which may comprise a thin glass wafer. The NiFe and the Rh are then electroplated. The structure is then stripped to the form shown in FIG. 11. FIG. 2 shows the bonded structure where support 70 is used to structurally support substrate 25 with respect to substrate 26. Support 70 may comprise any suitable solder, epoxy, adhesive or other suitable sealing material known to those skilled in the art.

In one preferred embodiment of this invention, seal 80 can be formed about a periphery of at least a portion of micromechanical switch 20, such as shown in FIG. 1. Seal 80 may comprise a suitable solder, a suitable epoxy or any other suitable adhesive that can bond to or with substrate 25 and substrate 26, to form a hermetric seal. In one preferred embodiment of this invention, support 70 may form at least a portion of seal 80. The material used to construct seal 80 preferably meets any necessary temperature constraints and outgassing needs of micromechanical switch 20. Also, the material of seal 80 can sealably surround and still allow movement of pushrod 56 or any other moveable element that mechanically moves magnet 50. Depending on the particular design of seal 80, the magnetic flux through conductive layer 30 and/or conductive layer 40 can penetrate the hermetic seal and actuate contact element 60.

Figure 12:
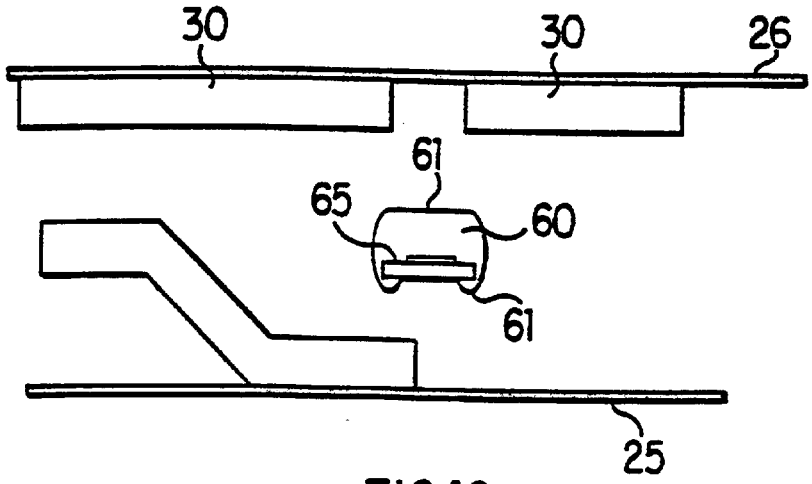
FIG. 12 is a schematic sectional view showing the contact element, as shown in FIGS. 2 and 3, and of a cantilever arm, according to one preferred embodiment of this invention.

FIG. 12 shows a schematic sectional view of micromechanical switch 20. In FIG. 12, head 61 is shown in a neutral position, such as the position shown in FIG. 1, where contact element 60 contacts neither conductive layer 30 nor conductive layer 40.

Figure 13:
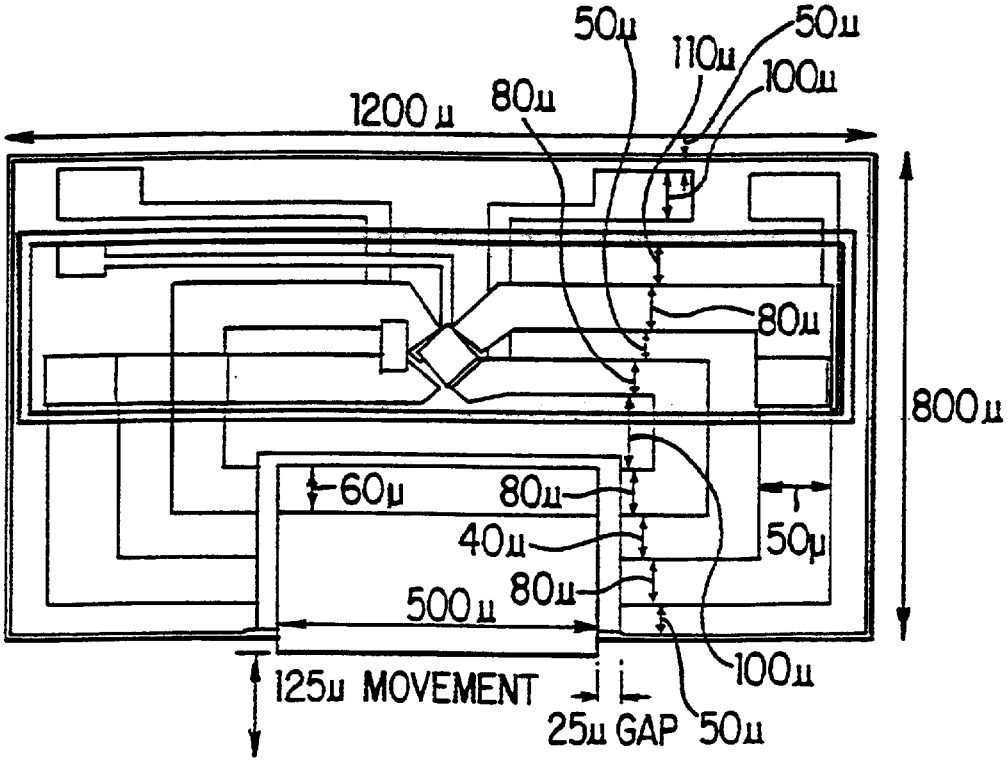
FIG. 13 is a schematic top view of a layout for a micromechanical switch, according to another preferred embodiment of this invention.

FIG. 13 is a schematic top view showing a layout of micromechanical switch 20, according to another preferred embodiment of this invention.

It is apparent that any other suitable method know to those skilled in the art of silicon microstructure design can be used in lieu of or in addition to the above-described process steps for manufacturing micromechanical switch 20 of this invention.

In a method for operating micromechanical switch 20, according to one preferred embodiment of this invention, magnet 50 is selectively moved between the magnet first position and the magnet second position. When magnet 50 is in the magnet first position, magnet 50 creates a magnetic flux that electromagnetically shorts conductive layer 30 and thereby draws or positions contact element 60 in the element first position where contact element 60 electromagnetically shorts conductive layer 30, such as across secondary opening 37, to electrically short conductive layer 30, common contact 27 and normally closed contact 29. When magnet 50 is in the magnet second position, magnet 50 creates a magnetic flux that electromagnetically shorts conductive layer 40 and thereby draws or positions contact element 60 in the element second position where contact element 60 electromagnetically shorts conductive layer 40 across secondary opening 47, to electrically short conductive layer 40, common contact 27 and normally open contact 28.

Figure 14:
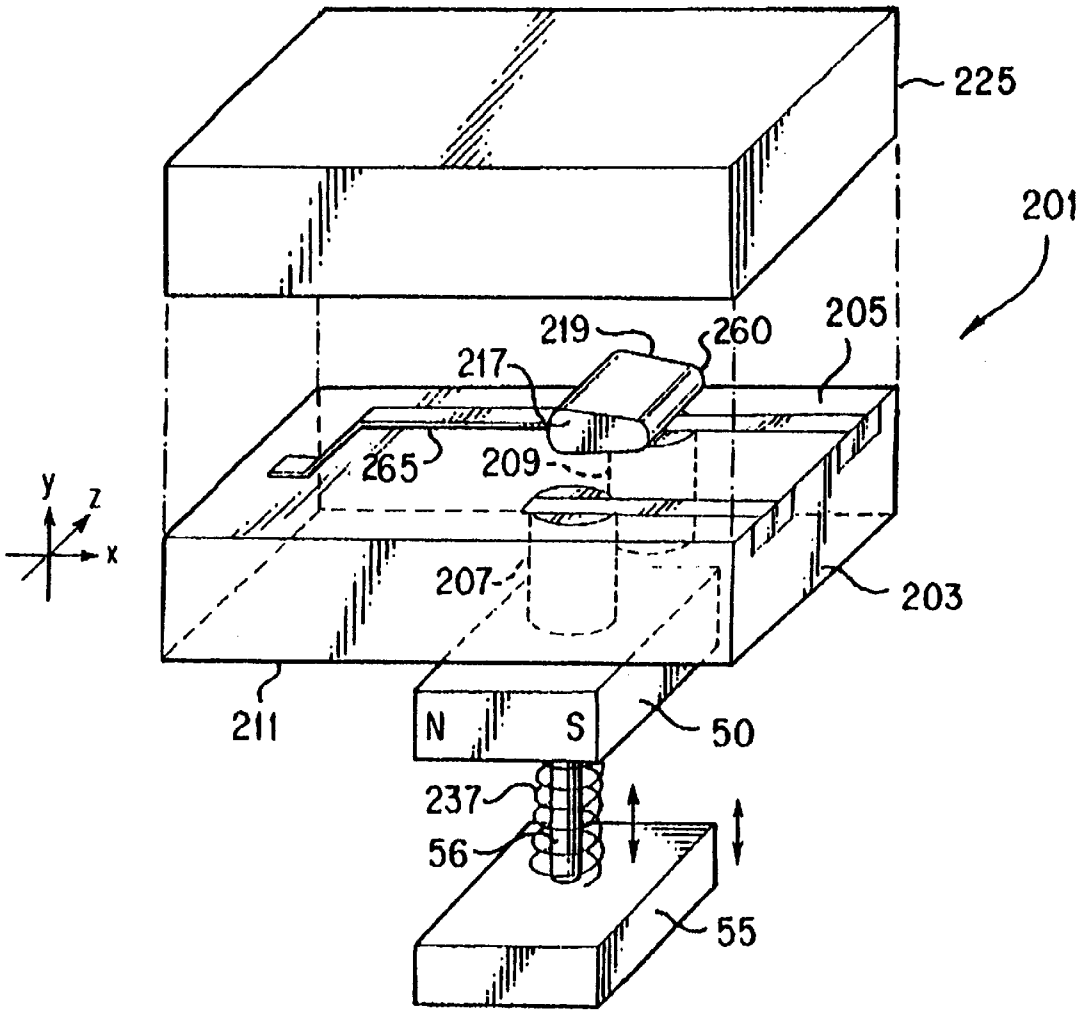
FIG. 14 is a schematic perspective view of an alternative embodiment of the present invention.

As seen in FIG. 14, an alternative embodiment of the micro-machined switch 201 is produced from a base layer 203 from which the cantilever 265 is etched, leaving the cantilever 265 and its head 260 free of the top surface 205 by about one thousandth of an inch, or one mil of travel in y axis of FIG. 14. First and second holes are then etched through the base layer 203 in the y axis from the top surface 205 of the base layer 203 to its bottom surface 211 beneath the cantilever tip and filled with first and second plugs 207, 209 of soft magnetic material which is preferably, but not necessarily, also electrically conductive, such as permalloy.

Figure 17:
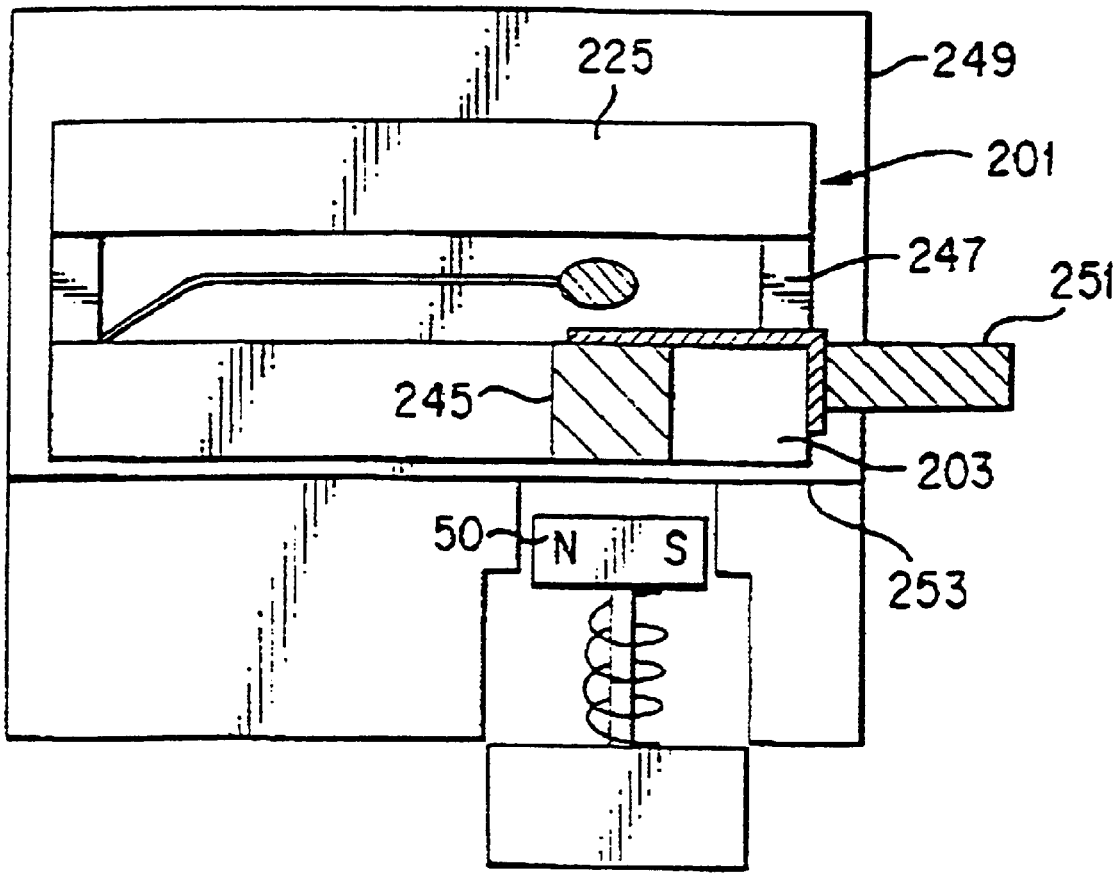
FIG. 17 is a cross-sectional side view of a commercially encased switch product according to the alternative embodiment of the micromechanical switch.

A single plug 245, such as may be inferred from FIG. 17 can be used although a lack of return path for the flux may make the magnetic action somewhat weaker. The first and second plugs 207, 209, respectively, serve as magnetic shunts for transferring magnetic flux from the permanent magnet 50 when located in its operative position adjacent the bottom surface 211. It will be appreciated that some liberties have been taken with the scale and positioning of the elements in the Figures as an aid to ease of illustration and understanding of the invention.

The plugs 207, 209 are electrically isolated with space between them in the Z axis, but are spaced so as to be contacted by first 217 and second 219 lateral sides of the cantilever head 260 along the Z axis thereof, when the cantilever head 60 is moved to contact with the plugs 207, 209, through magnetic attraction. Referencing also FIG. 15, first and second electrical leads 221, 223 are attached to the first and second plugs 207, 209, respectively, representing the open electrical circuit which the cantilever head 260 closes.

Figure 15:
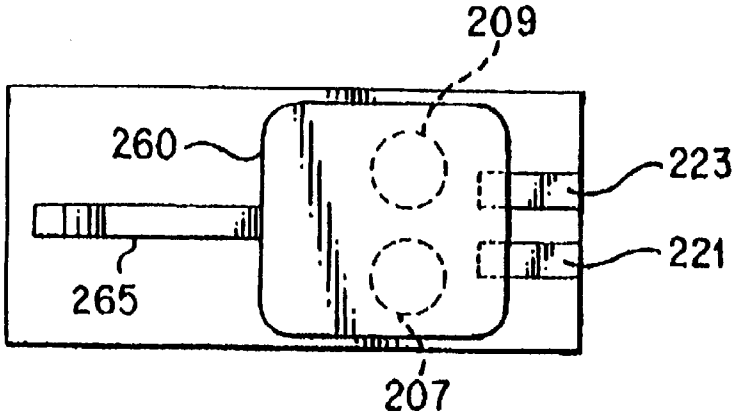
FIG. 15 is a top view of an embodiment similar to FIG. 14 which illustrates an alternative lead placement.

It will be appreciated that the plugs need not be electrically conductive and that suitable construction and arrangement of the elements may position the magnetic circuit, for motive force on cantilever tip, and the electrical circuit, which the cantilever tip bridges, as physically separate entities as indicated in FIG. 15.

The magnet 50 is located on a plunger or pushrod 56 and biased by a spring 237 or the like preferably away from the bottom surface 211 of the base layer 203. Magnet travel of about one and one half mils is considered adequate in the preferred embodiment.

Figure 16:
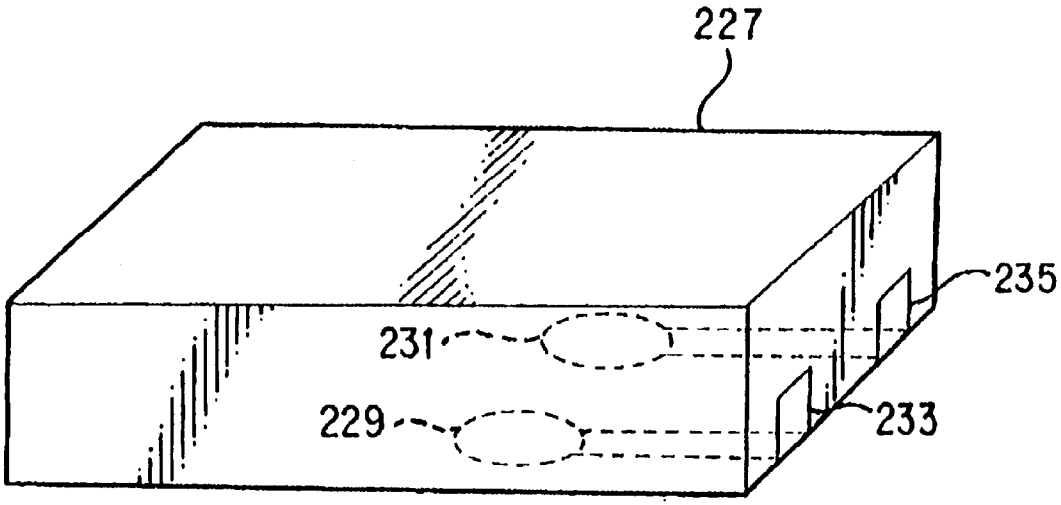
FIG. 16 is a perspective view of an alternative top cap for the embodiment of FIG. 14.

The top cap 225 serves as a cover for the SPST switch embodiment of FIG. 14 upon suitable sealing and spacing from the base layer 203 as discussed elsewhere. Referencing FIG. 16, an alternative cap embodiment 227 may have its own pair of electrical contacts 229, 231 with suitable connection to solder pads 233, 235. In this embodiment the top cap electrical contacts 229, 231 are placed so as to contact the cantilever head 260 in its normal, or at rest, position thereby enabling the present invention to serve as a normally open or normally closed double pole single throw, or DPST, switch mechanism.

Referencing FIG. 17, the micromechanical switch 201 having been assembled with spacers 247 between the base layer 203 and top cap 225, may then be assembled into a covering case 249 with outside leads 251 for the convenient utilization of the present invention. The micromechanical switch 201 may be further sealed by a hermetic layer 253 between the base layer and the magnet 50 at this time.

The embodiment of FIGS. 14–17 has low permanent magnet travel, and effective shunt construction to make a low cost, highly effective, and hermetically sealable switch utilizing very little substrate real estate.

It is apparent that different elements of this invention can be modified in shape, size, material and/or construction and still achieve the result of opening or closing micromechanical switch 20 in response to movement of magnet 50 that thereby causes contact element 60 to move between two positions.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A micromechanical switch comprising:

a base layer having first and second major opposing parallel surfaces and having a cantilever etched from the first major surface, the cantilever having an arm and a head;

first and second paired electrical leads being electrically isolated but spaced so as to allow contact with the cantilever head;

the cantilever head having a surface that is magnetically and electrically conductive;

the base layer having a magnetic shunt extending between the first and second major surfaces of the base layer and under the cantilever head so as to exert an attractive force on the head when carrying magnetic flux;

a permanent magnet movably locatable in a first position sufficiently adjacent to the second major surface and said magnetic shunt so as to transfer enough flux from the permanent magnet to draw the cantilever head to the electric leads and locatable at a second position at a distance sufficiently far from the second major surface so as to not transfer enough flux to draw the cantilever head to the electric leads.

2. The micromechanical switch according to claim 1 wherein the magnetic shunt extends through a body of the base layer between the first and second major surfaces.

3. The micromechanical switch according to claim 1 wherein there are first and second magnetic shunts spaced apart.

4. The micromechanical switch according to claim 3 wherein the shunts are electrically conductive.

5. The micromechanical switch according to claim 1 wherein the shunt is electrically conductive.

6. The micromechanical switch according to claim 1 further comprising:

an actuator mechanism for moving the magnet between the first and second positions.

7. The micromechanical switch according to claim 6 further comprising:

a pushrod and biasing means operatively connected to the permanent magnet.

8. The micromechanical switch according to claim 1 further comprising:

a top cap for sealing the first major surface and extending over the cantilever.

9. The micromechanical switch according to claim 8 further comprising:

a spacer between the top cap and the base layer.

10. The micromechanical switch according to claim 8 wherein the top cap is hermetically sealed to the base layer.

11. The micromechanical switch according to claim 8 wherein the top cap has third and fourth paired electrical leads being electrically isolated but spaced so as to allow contact with the cantilever head.

12. The micromechanical switch according to claim 1 wherein the cantilever is prestressed to contact one of the first and second or third and fourth electrical lead pairs and not contact the opposing electrical lead pair when not under magnetic influence.

13. The micromechanical switch according to claim 12 wherein the magnet in the first position exerts an attractive force to overcome the prestress of the cantilever and draw the head to the first and second paired electrical leads.

14. A micromechanical switch comprising:

a base layer having first and second major opposing parallel surfaces parallel to an x-z plane and having a cantilever extending in the x-axis and attached thereto, the cantilever having an arm and a head and being positioned adjacent the first major surface;

first and second electrical leads being electrically isolated but spaced so as to allow contact with the cantilever head, wherein an electrical circuit is formed by the first and second electrical leads;

the cantilever head having a surface that is magnetically and electrically conductive;

the base layer having first and second soft magnetic shunts spaced apart in a z-axis and extending through the base layer in the y-axis substantially under the cantilever head, wherein a magnetic circuit is formed by the first and second electrical leads;

a permanent magnet movably locatable in the y-axis at a first position sufficiently adjacent to the second major surface and said first and second magnetic shunts so as to transfer enough flux from the permanent magnet to draw the cantilever head to the electric leads and locatable at a second position at a distance sufficiently far from the second major surface so as to not transfer enough flux to draw the cantilever head to the electric leads;

an actuator mechanism for moving the magnet between the first and second positions; and a top cap for sealing the first major surface and extending over the cantilever.

15. The micromechanical switch according to claim 14 further comprising:

a casing surrounding the base layer, the top cap, and the actuator mechanism and having connecting electrical leads extending from the casing, the connecting electrical leads connected to said first and second electrical leads.

16. The micromechanical switch according to claim 14 wherein the top cap is hermetically sealed to the base layer.

17. The micromechanical switch according to claim 14 wherein the base layer is hermetically sealed from the magnet.

18. The micromechanical switch according to claim 14 wherein the base layer is silicon.

* * * * *